US007335088B1

(12) United States Patent
Hwang et al.

(10) Patent No.: US 7,335,088 B1
(45) **Date of Patent: *Feb. 26, 2008**

(54) CMP SYSTEM WITH TEMPERATURE-CONTROLLED POLISHING HEAD

(75) Inventors: Jerry Hwang, Hsin-Chu (TW); Cheng Hsun Chan, Hsin-Chu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/653,615

(22) Filed: Jan. 16, 2007

(51) Int. Cl.
*B24B 51/00* (2006.01)
*B24B 1/00* (2006.01)
*B24B 5/00* (2006.01)

(52) U.S. Cl. ..... 451/7; 451/53; 451/287

(58) Field of Classification Search ..... 451/7, 451/53, 388, 397, 287–289
See application file for complete search history.

(56) References Cited

U.S. PATENT DOCUMENTS

| | | | | |
|---|---|---|---|---|
| 5,605,488 | A * | 2/1997 | Ohashi et al. | 451/7 |
| 5,797,789 | A * | 8/1998 | Tanaka et al. | 451/289 |
| 5,873,769 | A * | 2/1999 | Chiou et al. | 451/7 |
| 6,162,116 | A | 12/2000 | Zuniga et al. | |
| 6,306,009 | B1 * | 10/2001 | Sandhu et al. | 451/7 |
| 6,607,425 | B1 | 8/2003 | Kistler et al. | |
| 6,749,484 | B2 * | 6/2004 | Yang et al. | 451/7 |
| RE39,471 | E * | 1/2007 | Nakashiba et al. | 451/5 |
| 2005/0239371 | A1 * | 10/2005 | Togawa | 451/5 |
| 2006/0205323 | A1 * | 9/2006 | Togawa et al. | 451/7 |

* cited by examiner

*Primary Examiner*—Hadi Shakeri
(74) *Attorney, Agent, or Firm*—Slater & Matsil, L.L.P.

(57) ABSTRACT

A chemical mechanical polish system for polishing a wafer includes a polishing head; an inner tube connected to the polishing head, wherein the inner tube is filled with a heat media; a media heater connected to the inner tube; and a pressure controller connected to the inner tube.

16 Claims, 6 Drawing Sheets

CMP SYSTEM WITH TEMPERATURE-CONTROLLED POLISHING HEAD

TECHNICAL FIELD

This invention relates generally to integrated circuit manufacturing equipments, and more particularly to equipments for chemical mechanical polish.

BACKGROUND

The chemical mechanical polish (CMP) is a common practice in the formation of integrated circuits. Typically, CMP is used for the planarization of semiconductor wafers. CMP takes advantage of the synergetic effect of both physical and chemical forces for the polishing of wafers. It is performed by applying a load force to the back of a wafer while the wafer rests on a polishing pad. A polishing pad is placed against the wafer. Both the polishing pad and the wafer are then counter-rotated while a slurry containing both abrasives and reactive chemicals is passed therebetween. CMP is an effective way to achieve global planarization of wafers.

A truly uniform polishing, however, is difficult to achieve due to various factors. For example, slurries are dispensed either from the top or bottom of the polishing pad. This will result in non-uniformity in polishing rate for different locations of the wafer. For example, if slurries are dispensed from the top, the edges of the wafers typically have higher CMP rates than the centers. Conversely, if slurries are dispensed from the bottom, the centers of the wafers typically have higher CMP rates than the edges. To reduce the non-uniformity in polishing rate, pressures applied on different locations of the wafers are adjusted. If the CMP rate in one region of a wafer is low, a higher pressure is applied to this location to compensate the low CMP rate. The increased pressure also serves the purpose of increasing the overall CMP rate, hence the increase in the throughput.

The method of compensating CMP rates through pressures, however, suffers limitations. Since pressures are typically applied through a single membrane, the increased pressure to one region of the wafer inevitably causes the increase in pressure to neighboring regions, and thus the compensation effect is reduced. Furthermore, high pressures applied to wafers may cause unwanted complexity to the wafers. A new CMP system is thus required to increase the CMP rate and/or improve the CMP uniformity without causing unwanted complexity to the wafers.

SUMMARY OF THE INVENTION

In accordance with one aspect of the present invention, a chemical mechanical polish (CMP) system for polishing a wafer includes a polishing head; an inner tube connected to the polishing head, wherein the inner tube is filled with a heat media; a media heater connected to the inner tube; and a pressure controller connected to the inner tube.

In accordance with another aspect of the present invention, a CMP system for polishing a wafer includes a polishing head; a plurality of inner tubes; a plurality of loading chambers in the polishing head and separated from each other, wherein each of the inner tubes is connected to one of the loading chambers; a membrane bordering the loading chambers; a plurality of media heaters, each being connected to one of the inner tubes; and a pressure controller connected to the inner tubes.

In accordance with yet another aspect of the present invention, a method of performing a CMP process to a wafer includes providing a CMP system comprising a polishing head; heating a pressure media in the polishing head; and attaching the wafer to the polishing head.

In accordance with yet another aspect of the present invention, a method of performing a CMP process to a wafer includes providing a CMP system comprising a polishing head; a plurality of inner tubes; a plurality of loading chambers in the polishing head, wherein each of the loading chambers is connected to one of the inner tubes; a membrane bordering the loading chambers, wherein the membrane is thermal conductive; and a pressure controller connected to the inner tubes. The method further includes connecting a plurality of media heaters each to one of the inner tubes; and heating a pressure media in the loading chambers during the CMP process.

The advantageous features of the present invention include increased polish rates and improved polish uniformity.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1:
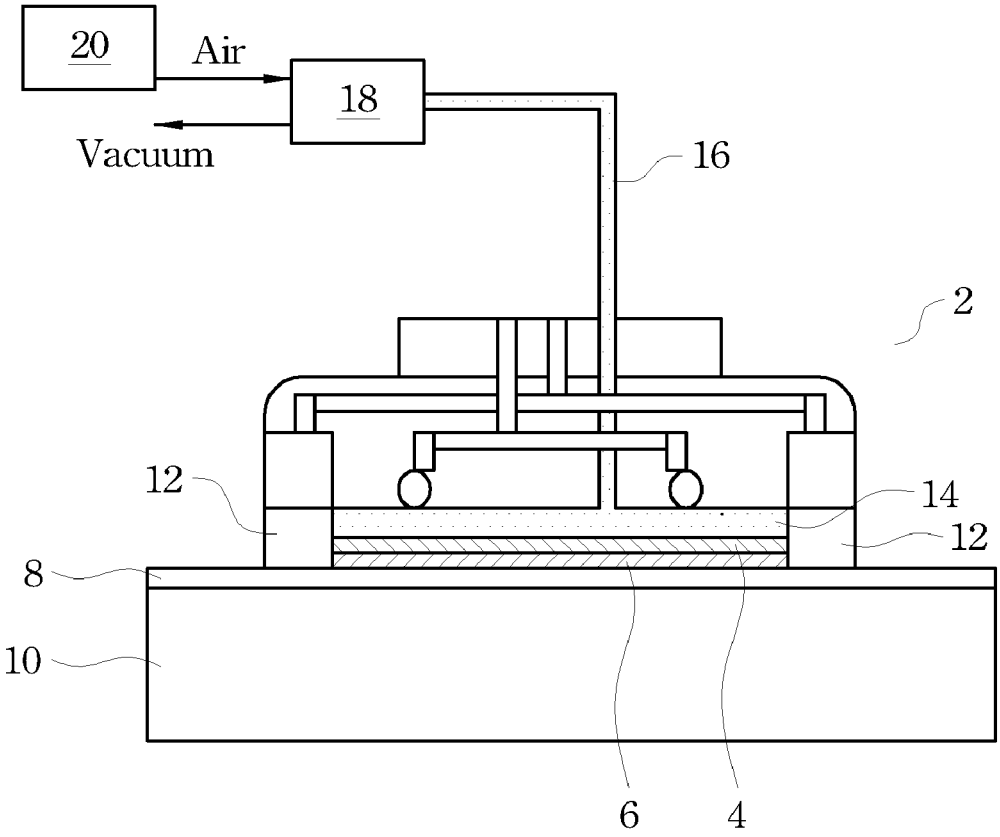
FIG. 1 illustrates a polish system of the present invention, wherein a polishing head is heated by air.

FIG. 1 schematically illustrates an exemplary chemical mechanical polish (CMP) system, which includes polishing head 2, membrane 4, wafer 6, and polish pad 8, which is in contact with wafer 6 during the polishing process. Polish pad 8 is attached to platen 10. During CMP processes, polish pad 8 spins at a constant rotation rate, while polishing head 2 moves back and forth between the center and the edge of polish pad 8. Because of the movement of polishing head 2 and polish pad 8, wafer 6 is polished.

Polishing head 2 includes retaining ring 12, which is an annular ring secured at the outer edge of polishing head 2. During CMP processes, wafer 6 is confined by retaining ring 12 so that it moves with polishing head 2. Membrane 4 is a circular sheet formed of a flexible and elastic material, wherein an edge portion of membrane 4 extends along inner surface of retaining ring 12. Membrane 4 acts as the bottom of loading chamber 14, which is connected to inner tube 16.

The CMP system further includes pressure controller 18, which controls the pressure in loading chamber 14. During CMP operations, pressure controller 18 provides a pressure media, such as air, to loading chamber 14 through inner tube 16. Throughout the description, the pressure media is alternatively referred to as a heat media for its additional functions. Since membrane 4 is elastic, with air pressure in loading chamber 14, a downward force is applied to wafer 6 by membrane 4. When the polish is completed, air is pumped out of loading chamber 14, and thus membrane 4 moves upward. As a result, a vacuum is formed above wafer 6, providing an upward force to wafer 6, which counters the surface tension between wafer 6 and the slurries. Wafer 6 is thus lifted.

In the preferred embodiment, the pressure media is preheated before it is pumped into loading chamber 14. In a first embodiment, media heater 20 is connected to pressure controller 18. In a second embodiment, media heater 20 is integrated into pressure controller 18. In a third embodiment, media heater 20 is attached to inner tube 16. Advantageously, the heated air in loading chamber 14 heats membrane 4, which further heats wafer 6. As is known in the art, a CMP process includes chemical reactions and mechanical actions, and the speed of the chemical reactions is sensitive to temperature. Generally, a higher temperature will result in an increase in the chemical reaction speed, and hence an increase in CMP rate. By increasing the temperature of wafer 6, the throughput of the CMP process can be increased.

In order to effectively conduct heat to wafer 6, membrane 4 needs to have a high thermal conductivity. Preferably, the thermal conductivity of membrane 4 is greater than about 0.2 W/(m*K), and more preferably greater than about 20 W/(m*K). In an exemplary embodiment, membrane 4 is formed of CoolPoly® E-series (Cool Polymers Inc.) materials. The thermal conductivities of CoolPoly® materials may range between about 1.0 W/(m*K) and about 100 W/(m*K), which are comparable to the thermal conductivity of pure iron.

Figure 2:
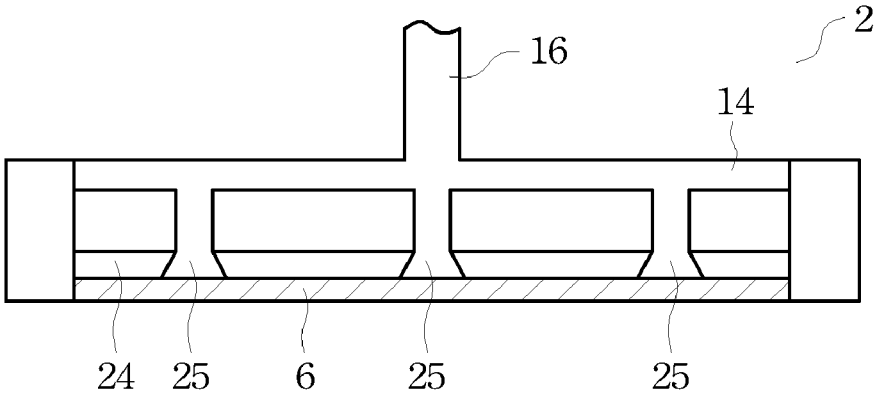
FIG. 2 illustrates a portion of a polishing head, wherein air is pumped to and from a back side of a wafer through a back film.

In alternative embodiments, as is illustrated in FIG. 2, polishing head 2 includes no membrane, while back film 24 is attached to the backside of wafer 6. Back film 24 includes a plurality of through-openings 25, through which the loading chamber 14 may provide preheated air to the backside of wafer 6, or vacuum from the backside of wafer 6. Similarly, loading chamber 14 is connected to inner tube 16, which is further connected to pressure controller 18 and media heater 20 (not shown).

Figure 3:
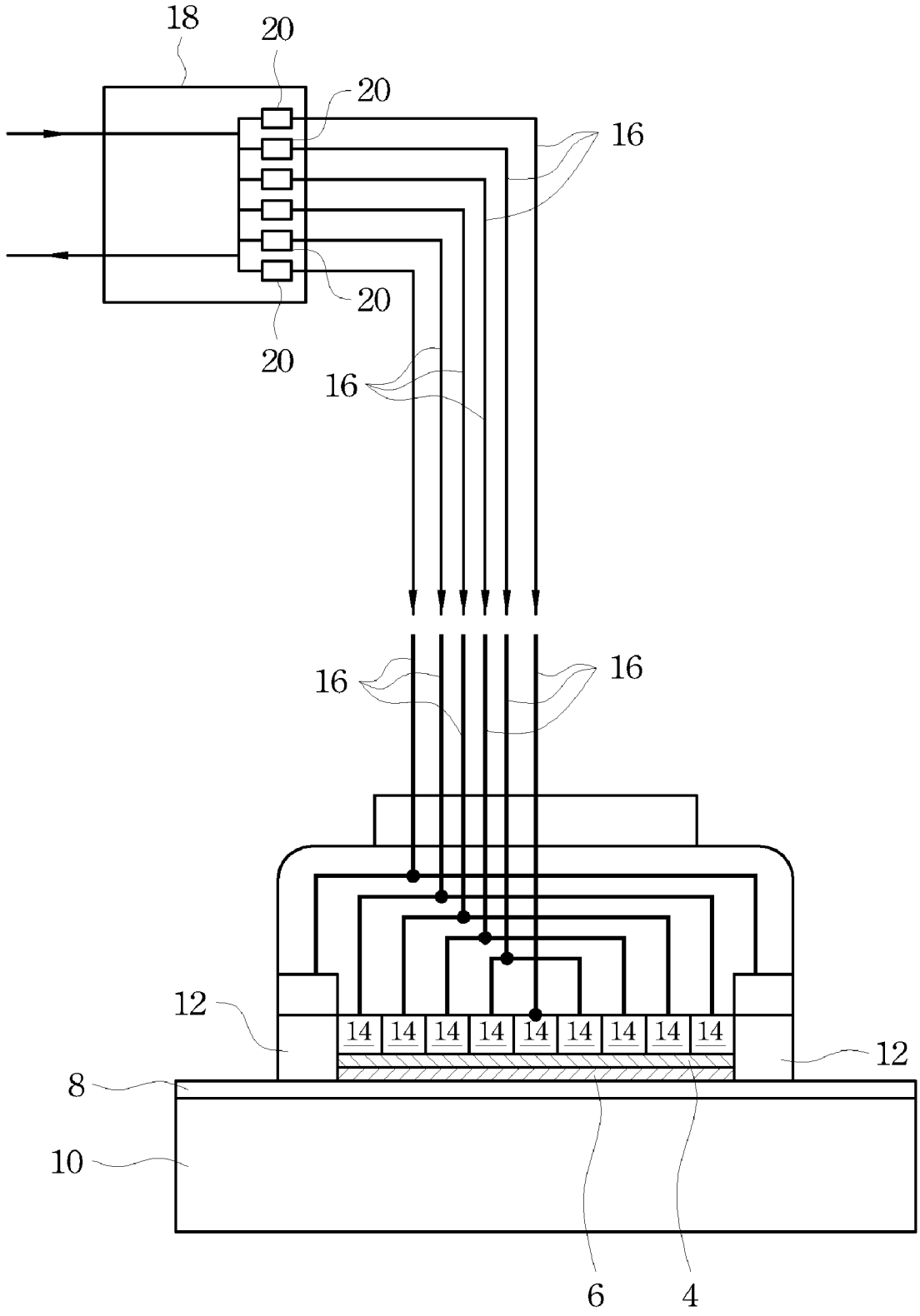
FIG. 3 illustrates a polish system, wherein a polishing head comprises a plurality of loading chambers.

In the embodiment shown in FIG. 1, only one loading chamber 14 is provided. In other embodiment of the present invention, more than one loading chambers 14 are provided, as illustrated in FIG. 3. Preferably, loading chambers 14 are concentric. Each of the loading chambers 14 is connected to one inner tube 16, which is further connected to pressure controller 18. In order to provide different loading chambers 14 with air that has different temperatures, each of the inner tubes 16 is connected to one media heater 20, which individually heats air to a desired temperature. Since loading chambers 14 are concentric, concentric regions (regions having a same distance from the center of wafer 6) on wafer 6 may be heated to a same temperature, while non-concentric regions may be heated to different temperatures. For example, loading chambers 14 proximate to the edge of wafer 6 may be provided with the air having a higher temperature than other inner tubes, and thus the CMP rate at the edge of the wafer is increased. It is realized that inner tubes 16 may be connected to a common media heater 20. However, the temperature of air pumped into each loading chamber 14 cannot be individually controlled in this case.

Figure 4:
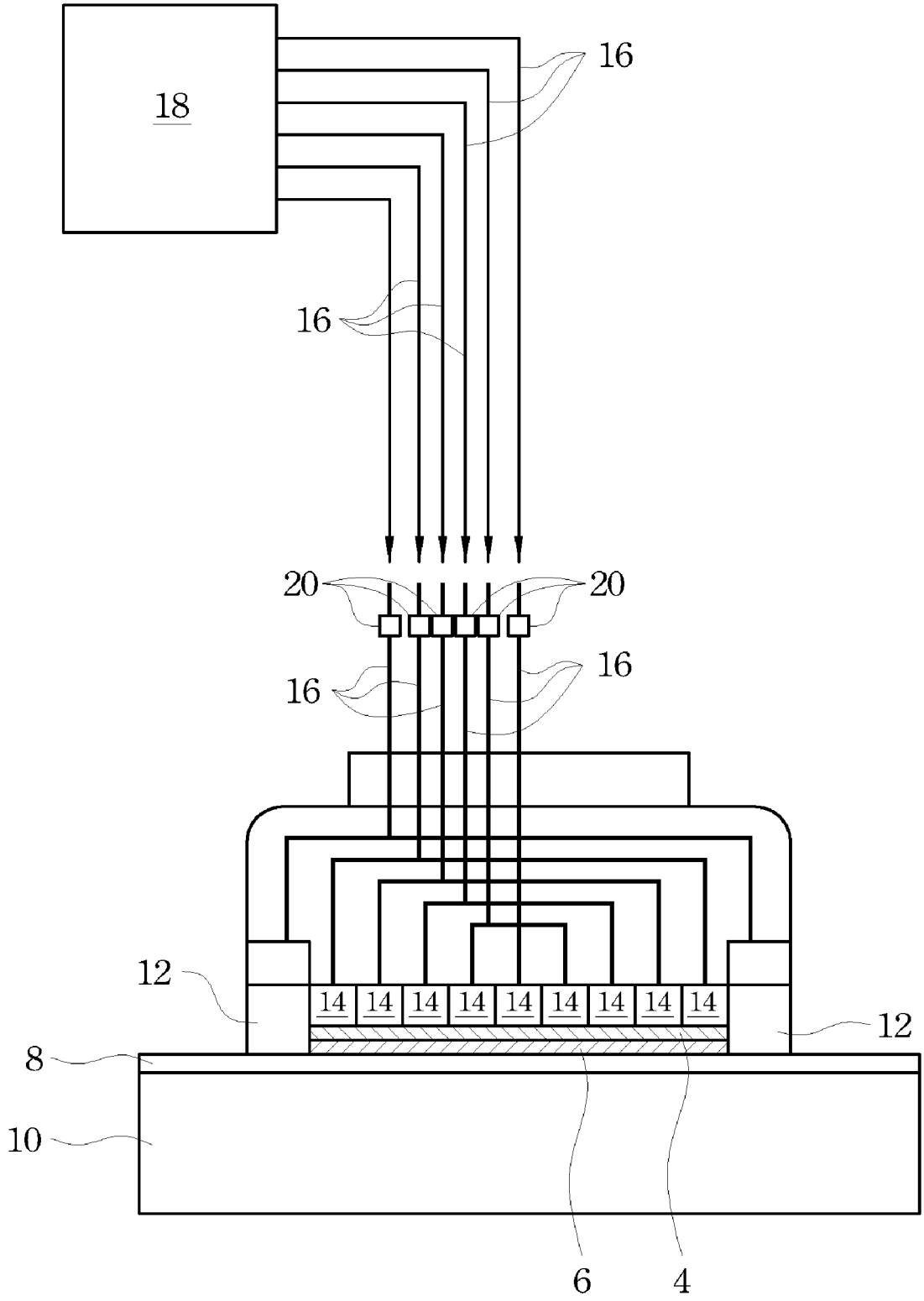
FIG. 4 illustrates a polish system including inline media heaters.

Referring to FIG. 4, in alternative embodiments of the present invention, media heaters 20 are attached to inner tubes 16, and air is inline-heated in inner tubes 16. Similar to the embodiment shown in FIG. 2, media heaters 20 may also heat air in different inner tubes 16 to different temperatures. In an exemplary embodiment, the inline media heaters 20 are placed as close to polishing head 2 as possible in order to more effectively heat the air.

Figure 5:
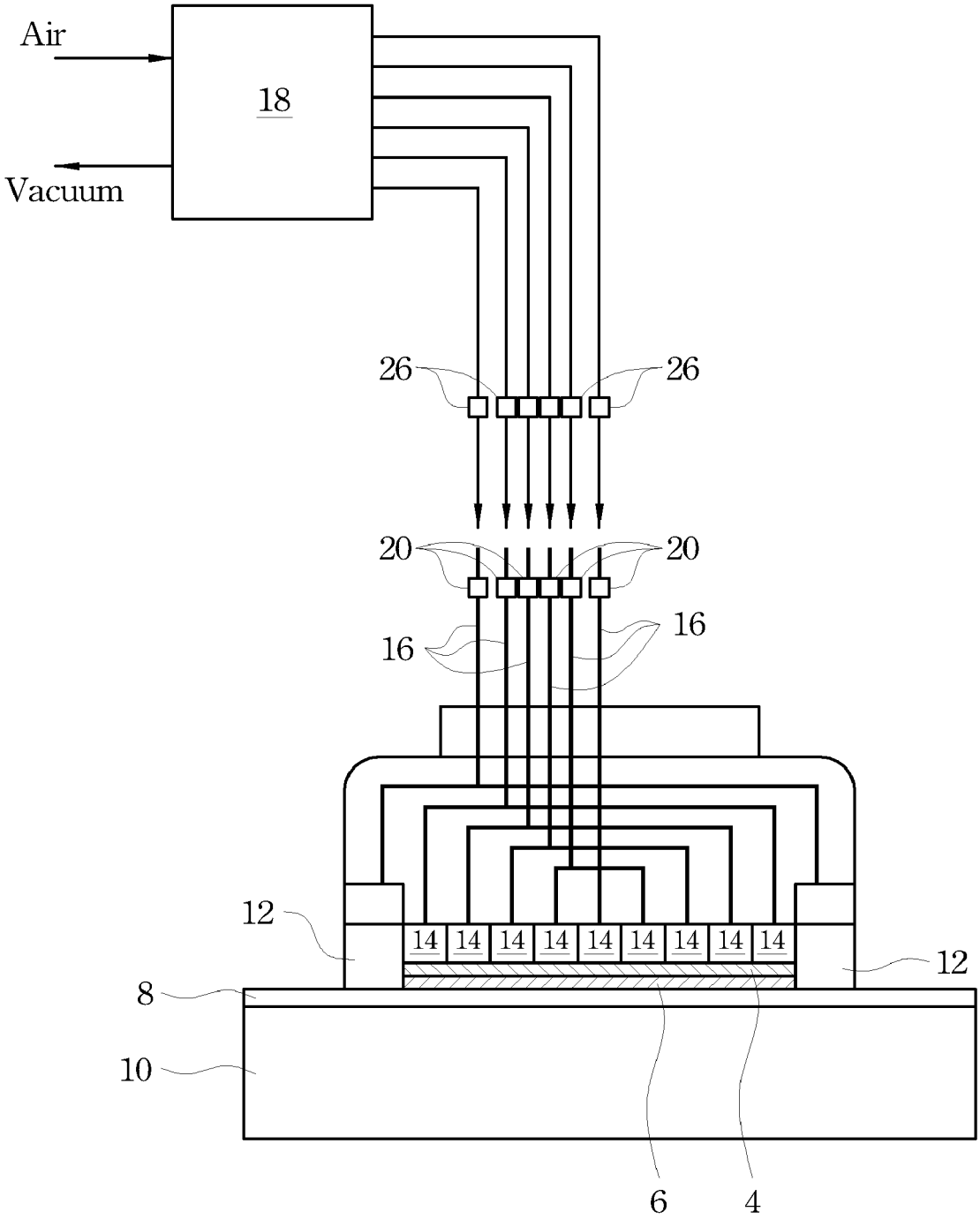
FIG. 5 illustrates a polish system using a liquid as a heat media, wherein an air-to-liquid converter passes an air pressure to a liquid pressure.

Air has a low thermal capacity, and thus the heat provided to wafer 6 is limited. In a variation of the present invention, materials having greater thermal capacities, such as water, oil, and the like, are advantageously used as the heat/pressure media in loading chambers 14. FIG. 5 schematically illustrates a scheme with a liquid used as the heat and pressure media. In this embodiment, each of the inner tubes 16 is attached with an air-to-liquid pressure converter 26 and an inline media heater 20. Loading chambers 14 are filled with a liquid, such as water, oil, and the like. Since loading chambers 14 are connected to inner tubes 16, the portion of an inner tube 16 between an air-to-liquid pressure converter 26 and the respective loading chamber 14 is also filled with the liquid. The thermal conductivity of the liquid is preferably higher than about 2 W/(m*K). Media heaters 20 are preferably attached to the liquid portion of inner tubes 16. Advantageously, during the CMP process, heat provided by inline media heaters 20 can be continuously conducted to wafer 6 through the liquid media.

Figure 6A:
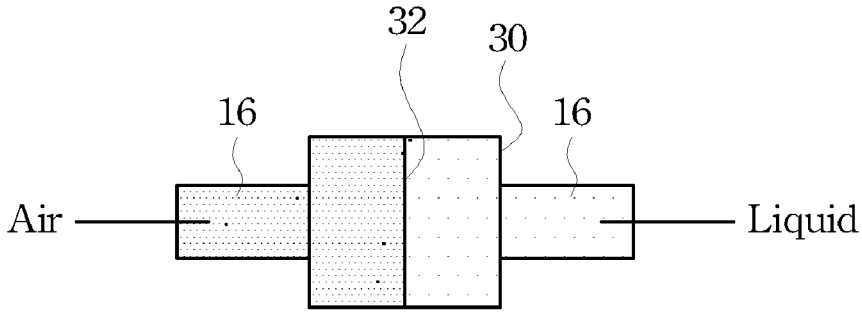
FIGS. 6A through 6C illustrate an exemplary air-to-liquid converter.
Figure 6B:
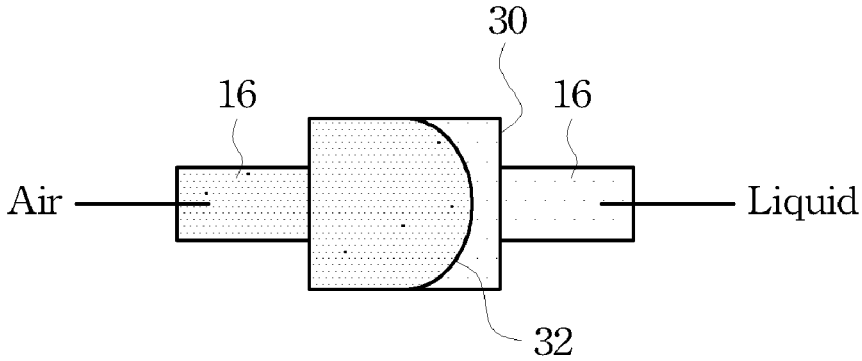
Figure 6C:
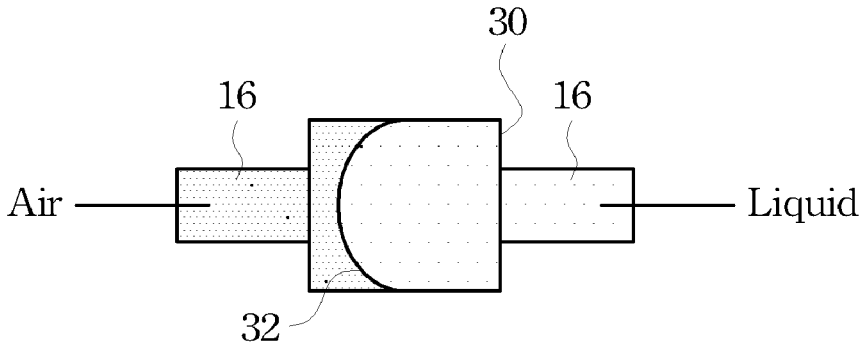

The portions of inner tubes 16 between air-to-liquid pressure converters 26 and pressure controller 18 are filled with air, which is provided by pressure controller 18. Air-to-liquid pressure converters 26 pass the pressure applied by pressure controller 18 to the liquid. FIG. 6A though 6C illustrate an exemplary embodiment of air-to-liquid pressure converters 26, which include a pressure chamber 30 with one end connected to pressure controller 18 through a portion of inner tube 16, and another end connected to loading chamber 14 through another portion of inner tube 16. Elastic membrane 32 separates and fully isolates pressure chamber 30 into two portions. Referring to FIG. 6A, if the pressure on left side of elastic membrane 32 equals the pressure on right side of elastic membrane 32, the elastic membrane 32 sits in the middle. If pressure controller 18 increases air pressure, elastic membrane 32 is pushed to the liquid heat media side (refer to FIG. 6B). If pressure controller 18 vacuums air out of inner tube 16, elastic membrane 32 is pushed to the air side (refer to FIG. 6C). In all three cases shown in FIGS. 6A through 6C, the pressures on both sides of elastic membrane 32 are substantially identical when equilibrium is reached. Therefore, the pressures controlled by pressure controller 18 are fully applied to loading chambers 14.

Figure 7:
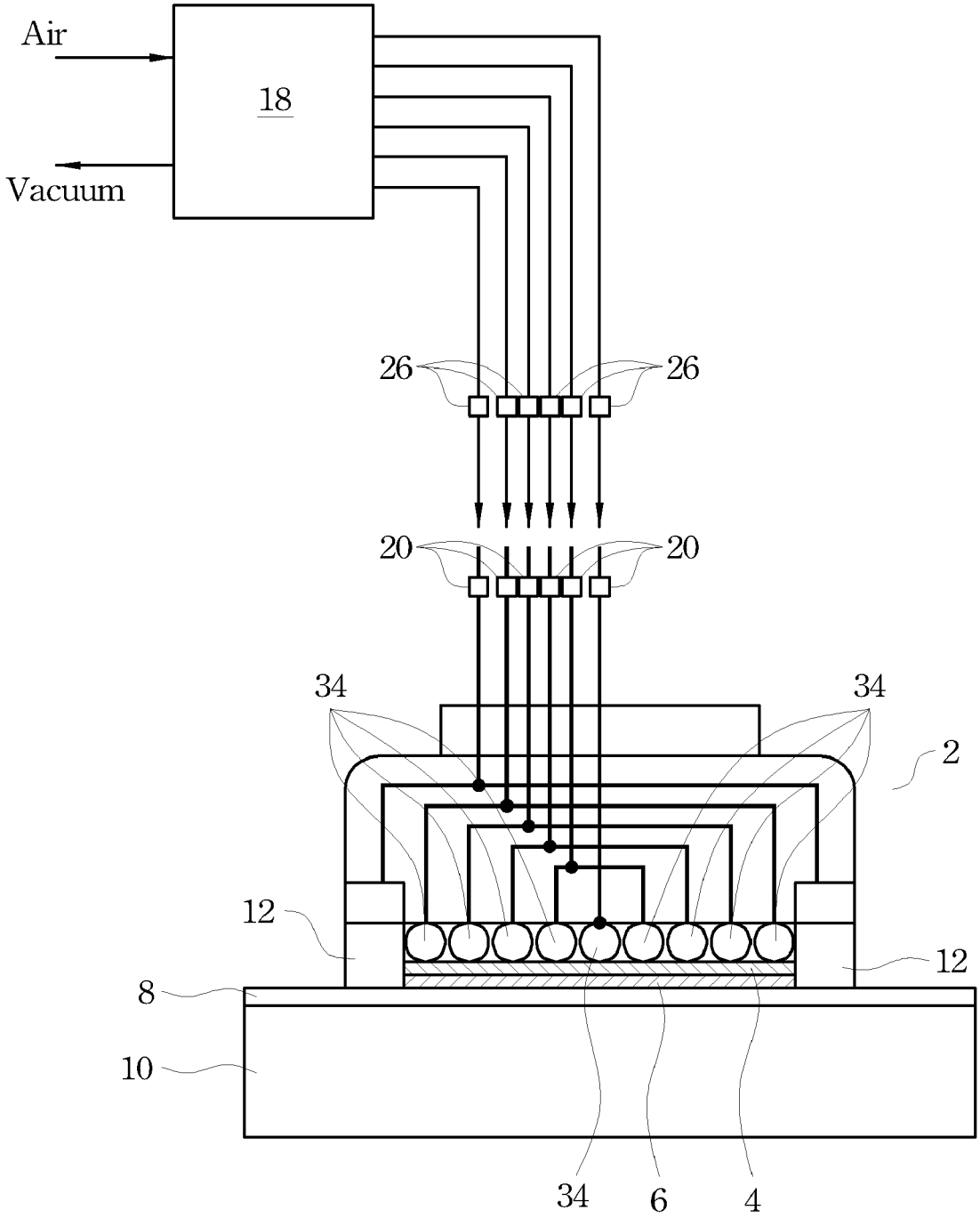
FIG. 7 illustrates an alternative embodiment having bladders for controlling pressures applied on wafers.

It is appreciated that even though polishing head 2 has various designs, the concept of heating and controlling temperatures on wafers may still be applied. FIG. 7 illustrates an alternative polishing head 2, wherein elastic bladders 34 replace loading chambers 14. Similar to the embodiments discussed in preceding paragraphs, the pressures of air or liquid in elastic bladders 34 are preferably controlled by pressure controller 18. By inflating or deflating elastic bladders 34, a downward or upward force can be applied. Elastic bladders 34 are thermal conductive, and thus the heated air or liquid therein may effectively pass heat to underlying membrane 4 and wafer 6. In alternative embodiments, membrane 4 may be omitted, and elastic bladders 34 directly apply pressure and conduct heat to wafer 6.

The embodiments of the present invention provide a method for heating a wafer in order to expedite the polishing rate. Furthermore, being able to control the temperatures of different portions of the polished wafer, the present invention provides a means for adjusting the polishing rate chemically, as compared to mechanically, by applying different pressures to different portions of the wafer. With the means provided by the present invention, more uniform polishing can be achieved.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A chemical mechanical polish (CMP) system for polishing a wafer, the CMP system comprising:

a polishing head;

an inner tube connected to the polishing head, wherein the inner tube is filled with a heat media;

a media heater connected to the inner tube;

a loading chamber in the polishing head and connected to the inner tube;

a membrane forming a side of the loading chamber, wherein the membrane is thermally conductive;

an air-to-liquid converter attached on the inner tube, wherein the air-to-liquid converter separates the inner tube into a first portion connected to the loading chamber and a second portion connected to the pressure controller, and wherein the first portion is filled with a liquid, and the second portion is vacuumed or filled with air, and wherein the media heater is attached to the first portion of the inner tube: and a pressure controller connected to the inner tube.

2. The CMP system of claim 1, wherein the membrane has a thermal conductivity of greater than about 0.2 W/(m*K).

3. The CMP system of claim 1, wherein the air-to-liquid converter comprises a chamber with an elastic membrane separating the loading chamber into two portions.

4. The CMP system of claim 1 further comprising:

an additional loading chamber in the polishing head, wherein the additional loading chamber is filled with the heat media; and an additional inner tube connected to the additional loading chamber, wherein the additional inner tube is connected to the pressure controller; and an additional media heater connected to the additional inner tube.

5. The CMP system of claim 4, wherein the loading chamber and the additional loading chamber have different temperatures.

6. The CMP system of claim 4, wherein the loading chamber and the additional loading chamber are concentric.

7. The CMP system of claim 1 further comprising a back film in the polishing head, wherein the back film comprises a plurality of through-holes connecting the inner tube and a back side of the wafer.

8. The CMP system of claim 1, wherein the media heater is connected to an opposite side of the pressure controller than the inner tube.

9. The CMP system of claim 1, wherein the media heater is built inside the pressure controller.

10. A chemical mechanical polish (CMP) system for polishing a wafer, the CMP system comprising:

a polishing head;

a plurality of inner tubes;

a plurality of loading chambers in the polishing head and separated from each other, wherein each of the inner tubes is connected to one of the loading chambers;

a membrane bordering the loading chambers;

a plurality of media heaters, each being connected to one of the inner tubes;

a pressure controller connected to the inner tubes, and a plurality of air-to-liquid converters, wherein each of the air-to-liquid converters is connected to one of the inner tubes, and wherein the loading chambers are filled with a liquid.

11. The CMP system of claim 10, wherein the media heaters are air heaters.

12. The CMP system of claim 10, wherein the liquid has a thermal conductivity of greater than about 0.2 W/(m*K).

13. The CMP system of claim 10, wherein the air-to-liquid converters each comprises a chamber and an elastic membrane separating the chamber into a first portion and a second portion, wherein the first portion is filled with the liquid and connected to one of the loading chambers, and the second portion is connected to the pressure controller, and wherein one of the media heaters is attached to the first portion.

14. The CMP system of claim 10, wherein the liquid in at least two of the loading chambers has different temperatures.

15. The CMP system of claim 10, wherein the plurality of media heaters are built in the pressure controller.

16. The CMP system of claim 10, wherein the plurality of media heaters each is attached to one of the inner tubes.

* * * * *